US005235239A

United States Patent [19]

Jacob et al.

[11] Patent Number: 5,235,239

[45] Date of Patent: Aug. 10, 1993

[54] WINDOW CONSTRUCTION FOR A PARTICLE ACCELERATOR

[75] Inventors: Jonah H. Jacob, Brookline; Allen M. Flusberg, Newton; Barbara J. Hughey, Arlington; Ruth Shefer, Newton; Robert Klinkowstein, Winchester, all of Mass.

[73] Assignee: Science Research Laboratory, Inc., Somerville, Mass.

[21] Appl. No.: 712,200

[22] Filed: Jun. 7, 1991

Related U.S. Application Data

[63] Continuation-in-part of Ser. No. 510,057, Apr. 17, 1990, abandoned.

[51] Int. Cl.[5] ..... H05H 1/00; H01J 27/00; H01J 33/00

[52] U.S. Cl. ..... 313/363.1; 313/420; 313/230; 315/111.81

[58] Field of Search ..... 313/363.1, 420, 230, 313/359.1; 315/111.81

[56] References Cited

U.S. PATENT DOCUMENTS

| | | | |
|---|---|---|---|
| 3,406,304 | 10/1968 | Brewster | 313/420 |
| 4,061,944 | 2/1977 | Gay | 313/420 |
| 4,122,967 | 10/1978 | Röhrich | 313/420 |
| 4,455,561 | 6/1984 | Boyden et al. | 313/420 |
| 4,763,042 | 8/1988 | Colomb et al. | 313/420 |
| 4,788,473 | 11/1988 | Mori et al. | 315/111.81 |
| 4,812,775 | 3/1989 | Klinkowstein et al. | 313/359.1 |
| 4,850,188 | 7/1989 | Testone | 313/230 |
| 4,952,814 | 8/1990 | Huntzinger | 313/420 |

*Primary Examiner*—Donald J. Yusko
*Assistant Examiner*—Brian Zimmerman
*Attorney, Agent, or Firm*—Wolf, Greenfield & Sacks

[57] ABSTRACT

Window constructions for use in particle accelerators to separate an evacuated accelerator beam chamber from a gas or liquid filled target area, which window structure enhances cooling of the foil covering the window opening and reduces stresses on the foil. For preferred embodiments, the window opening is shaped and dimensioned to provide high length-to-width aspect ratio and a rectangular shape with rounded corners. The openings should generally be as narrow as possible while still being wide enough to assure efficient transmission of the ion beam. Stresses in the foil is reduced by providing controlled bowing of the portions of the foil covering the window. This may be accomplished by providing some slack in the foil, at least in one dimension, but is preferably accomplished by pressing the foil between mating curved surfaces selectively extending from the edges of the window openings, resulting in the desired bow in the foil in the window area. With a rectangular opening, the bow is preferably a generally cylindrical bow about an axis parallel to the length dimension of the window. A generally spherical bow may also be utilized. A plurality of adjacent generally rectangular openings separated by struts are also utilized for some embodiments.

21 Claims, 3 Drawing Sheets

WINDOW CONSTRUCTION FOR A PARTICLE ACCELERATOR

This application is a continuation-in-part of Ser. No. 07/510,057, filed Apr. 17, 1990, now abandoned.

Field of the Invention

This invention relates to particle accelerators and, more particularly, to a window construction for use in such accelerators to separate an evacuated accelerator beam chamber from a gas or liquid filled target chamber or other area, which window structure enhances cooling of the foil covering the window opening and reduces stresses on the foil.

BACKGROUND OF THE INVENTION

A new generation of ion accelerators is being developed, such as the ion accelerator shown in U.S. Pat. No. 4,812,775, issued Mar. 14, 1989, and entitled "Electrostatic Ion Accelerator", which accelerators operate at low voltage and low power, but which operate at high currents in order to achieve critically significant saturated yields of radioisotopes required for applications such as medical imaging. The ion beams for accelerators of this type are generated in, for example, a tandem accelerator such as that shown in the aforementioned patent, which operates in a vacuum and the beams are transmitted through a window covered by a thin foil to a fluid filled target chamber, which fluid may be a gas or a liquid. The fluid filling the target chamber will depend on the isotopes being generated, and will thus vary with application.

However, low energy, high current accelerators require approximately 40 times more cooling capacity for the foil window separating the accelerator and target chambers than a high energy accelerator having comparable yields. The reasons for the more severe foil cooling requirements for low energy accelerators include (a) the fact that the lower beam energy results in the deposition of a larger fraction of the instantaneous beam power in the foil (i.e. the foil tends to absorb more of the incident energy) and (b) the higher currents required to produce clinically significant radioisotope yields for such lower energy accelerators. It has been found that for the low energy accelerators, roughly 5% to 10% of the power in the ion beam is deposited in the foil. For a 3.7 MeV, 1 mA beam, this results in about 180 watts being deposited in the foil. This is roughly the power that must be removed from the foil by cooling. As indicated above, this is approximately a factor of 40 larger than the 3–5 watts that has to be removed from the foil in a system using a 10 MeV, 50 $\mu$A ion accelerator. A need, therefore, exists for a more efficient construction to remove the accumulated heat from the foil to keep the foil from disintegrating or rupturing as a result of melting or softening. chamber. Such foil window must in each instance be able to withstand the substantially pressure differential thereacross, which is normally equal to atmospheric pressure, and to dissipate the small fraction of the particle beam energy, generally 1 to 10% of such energy, that is absorbed in the foil.

A need, therefore, exists for an improved foil window construction for particle accelerators which provides significantly enhanced cooling capacity for the foil window and which results in a substantial reduction in the stresses applied to the foil.

SUMMARY OF THE INVENTION

In accordance with the above, this invention provides an improved window construction for use in an electron, ion or other particle accelerator of a type having an evacuated accelerator beam chamber which is separated by the window from a fluid (i.e. gas or a liquid) filled target chamber or other target area. The window construction has first and second housing members, each of which has a window opening formed therein. The window openings for some embodiments are of substantially like size and may have a high length-to-width aspect ratio. For preferred embodiments, the members have Another problem related to the foil is the stress induced in the foil as a result of the atmospheric pressure differential between the target chamber on one side and the accelerator beam vacuum chamber on the other side of the foil. This stress, caused at least in part by uncontrolled stretchings of the foil, could result in rupture of the foil and, thus, in reduced foil life and increased maintenance on the accelerator.

The problems discussed above and in particular the problem of foil stress resulting from a pressure differential across the foil, also arise in other types of high energy particle accelerators including, for example, high energy electron beam accelerators which may be utilized for a number of processes including cross linking of cable and wire insulation and the reductions of various emissions from stack gasses. In all such electron beam applications and in many other applications where high energy particles, particularly high energy charged particles, are generated in an evacuated chamber and utilized in a chamber or other area which is at atmospheric or other pressure higher than that in the accelerator chamber, the particle beam must be passed through a sealing foil window in order to permit the vacuum to be maintained in the accelerator mating curved surfaces selectively extending from the ends o the window openings. The housing members are preferably formed of material with good heat transfer properties.

A thin foil is mounted between the housing members, fully covering the window openings and extending beyond the openings on all sides. The housing members are secured together with a substantially air tight seal being provided therebetween. There is also a means for providing a controlled bowing of the portion of the foil covering the window openings. For preferred embodiments, this is achieved by forming the portion of the foil extending between the curved surfaces into the curved surface shape, causing the portion of the foil covering the window opening to have the same curve. For other embodiments, the curve is achieved by having the extent of the foil in at least one dimension being greater than the extent of the window opening in such dimension, whereby there is some slack in the foil in such dimension. The curve for some embodiments is preferably a cylindrical curve having an axis extending parallel to the length dimension of the window and the curve in the area of the window openings preferably bows in the direction of the evacuated beam chamber. Such window openings preferably have a high length-to-width aspect ratio and a rectangular shape with rounded corners. The width of the opening and the foil are preferably as narrow as possible while still providing efficient particle transmission. The window may also have a circular shape with a spherically bowed foil.

The openings are sealed by, for example, use of a sealing ring which extends around the opening with the foil being clamped against the ring to seal the opening, or by the use of other sealing material between the housings on all sides of the openings.

A cooling fluid is preferably circulated through at least one of the housings in the area thereof adjacent the foil. For one embodiment, cooling fluid is circulated through a fluid channel which is formed in one of the housing members and extends around the periphery of the opening.

For another embodiment of the invention, there is a corresponding plurality of adjacent window openings in each of the first and second housings, each pair of adjacent openings being separated by a strut, and each of the adjacent window openings having a high length to width aspect ratio. For this embodiment, the ratio of the window opening widths for the adjacent window openings to the widths of the struts therebetween should be as large as possible while still achieving required cooling. To reduce the loss of particles coming in at an angle, the length of the struts for at least one of the housings may be reduced. Cooling fluid may also be circulated through at least some of the struts to enhance cooling.

For some embodiments, at least one member has a surface adjacent the foil with a curved shape matching the desired controlled bowing of the foil. The foil is formed on such surface, for example, by being vapor deposited thereon, and a portion of the member is then removed by, for example, chemical dissolution or etching to form the window opening.

The foregoing and other objects, features and advantages of the invention will be apparent from the following more particular description of preferred embodiments of the invention as illustrated in the accompanying drawings.

IN THE DRAWINGS

DETAILED DESCRIPTION

Figure 1:
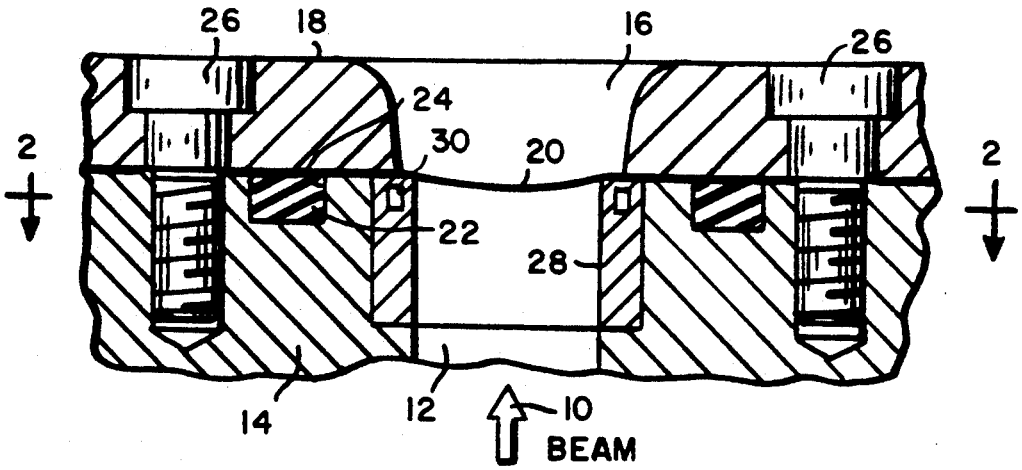
FIG. 1 is a cutaway side view of the window area of a particle accelerator in accordance with a first embodiment of the invention.
Figure 2:
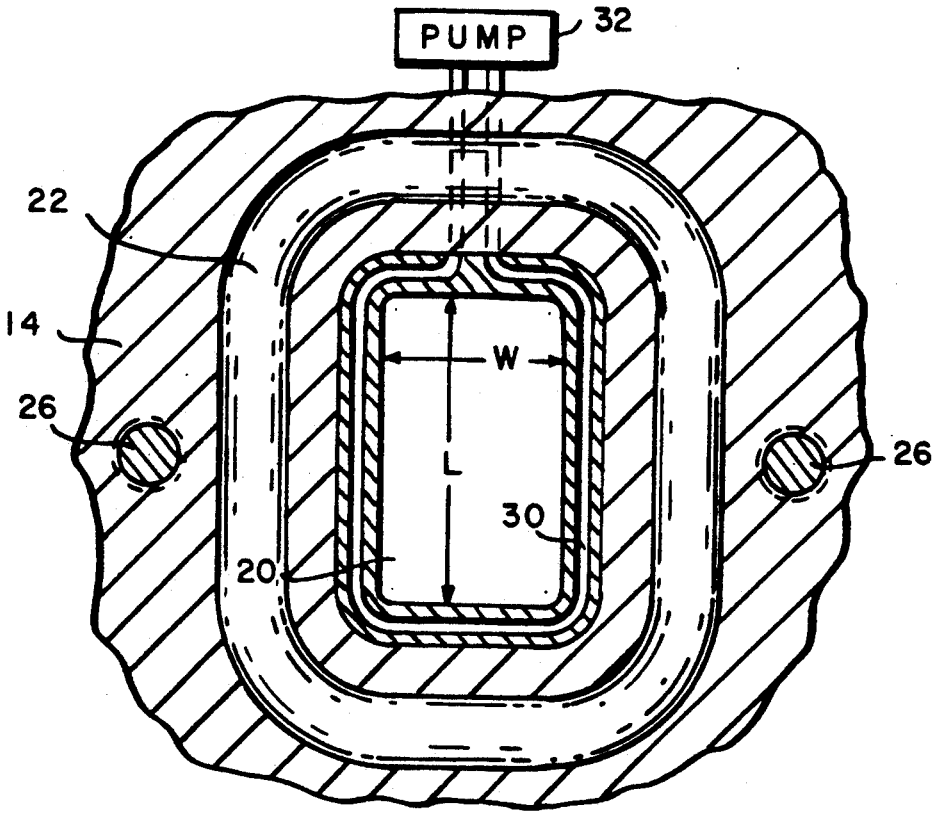
FIG. 2 is a top sectional view taken along the line 2—2 in FIG. 1.

Referring first to FIGS. 1 and 2, a particle beam 10 from a suitable source, such as the ion source shown in the beforementioned U.S. Pat. No. 4,812,775, is applied through a chamber 12 formed in a housing 14, which chamber is evacuated by suitable means to be at vacuum pressure. A chamber 16 is provided which is defined at least in part by housing 18 and contains an appropriate fluid target substance which may be a liquid or a gas. The substance in chamber 16 will depend on the system application. Housings 14 and 18 are preferably formed of a metal such as aluminum or other material having good strength and heat conduction properties.

The opening at the end of chamber 12 is covered by a suitable foil 20, which foil extends beyond the sides of the openings on all sides, separates the chambers 12 and 16 and permits vacuum pressure to be maintained in chamber 12. Suitable materials for the foil 20 might, for example, be Havar, aluminum, titanium, berylium, or diamond. The window opening preferably has straight sides with rounded corners as shown in FIG. 2. This facilitates passage of the ion beam. An elastic O-ring 22, seated in a corresponding recess in housing 14, secures foil 20 in place when housings 14 and 18 are clamped together by screws 26 or other suitable means, the O-ring 22 being deformed when the foil which passes thereover is clamped between housings 14 and 18, so as to seal the opening at the end of chamber 12.

Finally, a ring 28 of a material with good heat conduction properties is friction mounted in a suitable countersink in chamber 12. A fluid channel 30 is formed in ring 28 which, as can be best seen in FIG. 2, extends around the periphery of the opening formed at the end of chamber 12 (i.e. the opening covered by foil 20) and out an edge of the device to a pump 32. A suitable cooling fluid, such as water, may be pumped through channel 30 to assist in the cooling of foil 20.

As previously indicated, there are two problems experienced with the foil 20 which this invention is designed to deal with. The first problem relates to heat dissipation. Because the beam 10 is at low energy, for example, 3–4 MeV, a larger fraction of the incident beam power is deposited in the foil, perhaps 5% to 10% of the incident beam. The higher currents required to produce medically significant radioisotope yields for such lower energy also result in increased heating. In order to reduce or control the temperature of the foil which could otherwise increase to destructive levels as a result of this heating, it is desired that the path from any point on foil 20 to housings 14 and 18, and particularly to ring 28 and channel 30, be as short as possible while maintaining the window area at a fixed value. One way for this objective to be achieved is for the aspect ratio of foil 20 (i.e. the ratio of its length L to its width W) to be as large as possible. The narrower the foil 20, the closer points in the middle of the foil are to a side edge. While for the embodiment of the invention shown in FIG. 2, to simplify the drawings, an aspect ratio of approximately 3 to 1 has been shown, this is generally near minimum aspect ratio for which desirable results are achieved, the minimum such ratio being approximately two. It is preferable that the aspect ratio be at least 10 to 1 and, in practice, ratios of 30 to 1 have been utilized. For example, for a 15 square centimeter window, a width dimension of 0.75 centimeters was used with a length dimension of 20 centimeters. In general, it is desired that the span or width of the foil be as narrow as possible while still being wide enough to insure efficient transmission of the ion beam 10 from chamber 12 to target chamber 16.

The second problem discussed earlier is the stress on the foil 20 resulting at least in part from the pressure differential between chambers 12 and 16. Fortuitously, reducing the width of foil 20 also reduces the stress induced in the foil as a result of this pressure differential. Further, it has been found that if the width dimension of the foil 20 is made larger than the width between the two sides of ring 22 which secure the foil in the width dimension by, for example, 2 to 5% for a particular case, the resulting slack in foil 20 causes up to an order of-magnitude stress reduction in the foil. For other cases, the percentage of slack may vary substantially depending on system parameters. The pressure differential across the foil results in a generally cylindrical shaped bowing of the foil in the direction of evacuated chamber 12. By combining these two features, namely, some slack in the foil between the two sides of O-ring 22 and keeping the width of the window opening a the end of chamber 12, and thus of the foil 20 spanning such opening, as low as possible, foil life can be substantially enhanced, permitting foils to be selected for additional properties such as low density and high thermal conductivity rather than strength alone.

Figure 3:
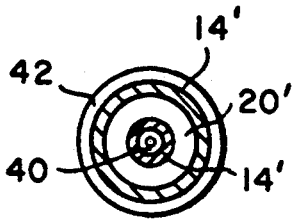
FIG. 3 is a partial top sectional view for an alternative embodiment of the, invention.

For preferred embodiments of the invention, a high perimeter to area ratio for a given area is achieved by having a high aspect ratio window; however, this result could also be achieved by having the window, and thus the foil, in the form of an annulus as shown in FIG. 3. For this embodiment, the foil 20' has an opening in the center with part of the housing 14' in this opening and a cooling fluid channel 40 in the housing inside the annulus. A portion of the housing 14' is also adjacent the outer wall of the foil 20' and has a fluid channel 42 adjacent thereto. Thus, no portion of the foil is far from a heat dissipating surface.

However, the construction of FIG. 3 is not considered as desirable as that of FIG. 2 in that the beam needs to have an annulus formed therein to correspond to the annulus in the foil, resulting in far more complex beam optics for the system and a generally more complex system which offers little, if any, advantages over the construction shown in FIG. 2.

Figure 4B:
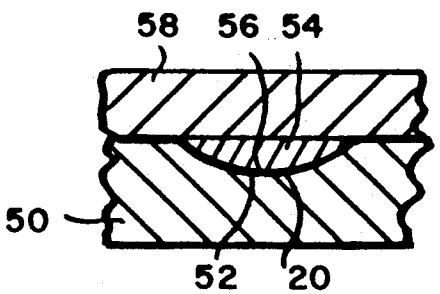
FIGS. 4A and 4B are cutaway side views of a second alternative embodiment of the invention taken at the window and at a point spaced lengthwise from the window, respectively.
Figure 4A:
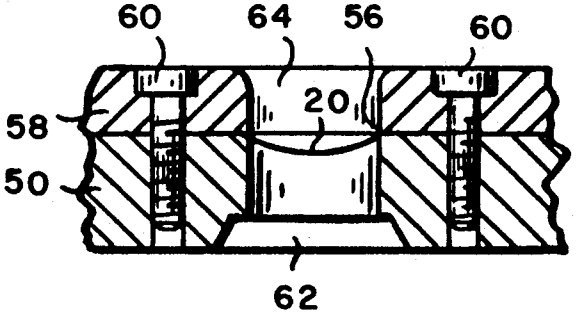

FIGS. 4A and 4B illustrate another embodiment of the invention which offers the advantages of the embodiment shown in FIGS. 1 and 2, but is considered preferable because it provides a controlled shape for foil 20, and thus assures that the foil does not crinkle or that other irregularities do not occur in the shape of the foil which might adversely affect the life of the foil, might interfere with the passage of accelerated particles therethrouqh or which might compromise the seal between the two chambers.

The window openings for this embodiment of the invention would preferably have the high length-to-width aspect ratio, generally rectangular shape shown in FIG. 2. While a fluid channel 30 has not been shown in FIGS. 4A and 4B to simplify these drawings, such a channel would normally be provided for this embodiment to ensure adequate cooling.

As may be best seen in FIG. 4B, which is a sectional view taken, for example, just below the window (from a FIG. 2 like view), the embodiment has housing members 50, 54 and 58. Housing member 50 may be the same as housing 14, but is shown in the figure as being a separate housing forming part of a window junction which may be inserted and secured between the two chambers. This member has a surface with a curved depression 52 formed therein, which depressions extend from each longitudinal end of the window opening and may have a variety of curved shapes, but are preferably cylindrical. Foil 20 is laid on top of the surface having depressions 52 with the foil 20 covering the window openings and extending beyond the window openings on all sides. Housing member 54 has a curved surface 56 which exactly matches curved surface 52 and is laid on top of the foil. A housing member 58 is laid on top of member 54, and as seen in FIG. 4A, screw holes 60 are provided through housing members 50 and 58 which may be used to hold the assembly together. Corresponding window openings are provided in each of the members 50, 54 and 58.

When the assembly shown in FIGS. 4A and 4B is assembled, the foil 20 is caused to have a cylindrical curve with an axis parallel to the longitudinal dimension of the window by being pressed between curved surfaces 52 and 54 at both the top and bottom of the window aperture, resulting in the foil having a cylindrical curve as it passes lonqitudinally (i.e. from top to bottom as shown in FIG. 2) across the aperture. The curve is bowed toward the chamber from which the beam originates, which chamber is at vacuum pressure. Foil 20 is thus permanently secured in the curved position which it would normally assume as a result of the pressure differential between the two chambers. Since the bow is put in the foil before sealing occurs, the bow does not result in any significant stretching of the foil, thus eliminating the stretching stresses which would otherwise occur as a result of the bow being caused by the pressure differential. It also eliminates to a large extent the changes in bowing, and thus in stresses applied to the foil, as a result of changes in the pressure differential across the foil, and thus minimizes stress differentials on the foil.

Another feature shown in FIG. 4A is the chamfered countersink 62 in housing member 50 in the area of the window opening formed therethrouqh and the bow or cutout 64 in the housing member 56 in the are of the window. These countersinks permit the housing member utilized to be thick enough to provide adequate cooling for the foil, while reducing the thickness of the housing members in the window area so as to minimize the interference with the passage of particles entering the window area at angles not parallel to the window walls.

Figure 5A:
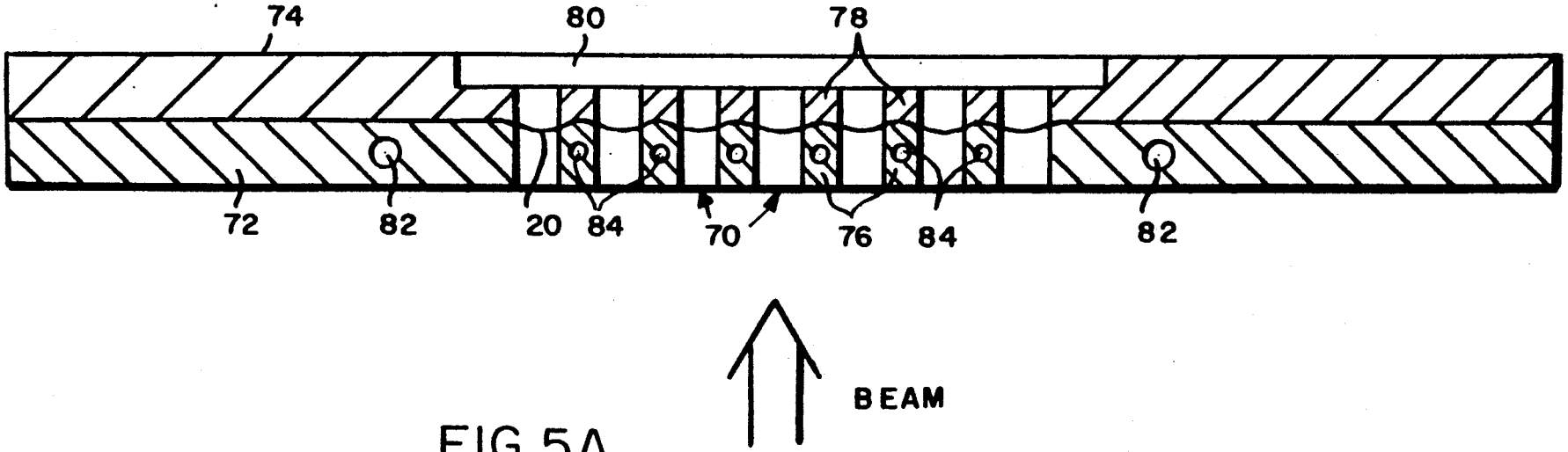
FIGS. 5A and 5B are a cutaway side view and a top view, respectively, of a third alternative embodiment of the invention.
Figure 5B:
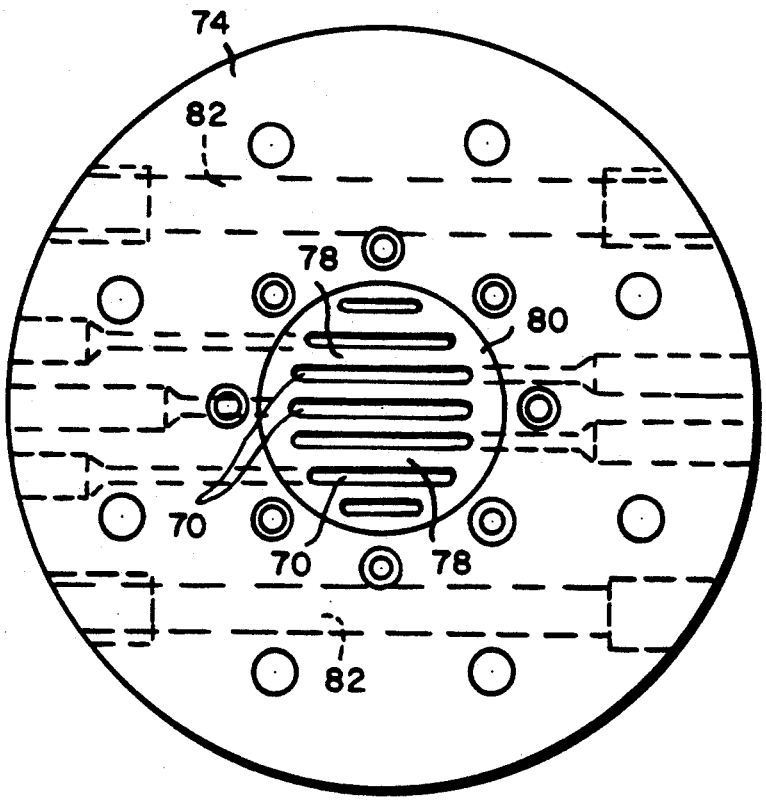

FIGS. 5A and 5B show an embodiment of the invention which deals with the problem that the particle beam typically has a circular cross section while, for reasons discussed above, the window opening preferably has a high aspect ratio rectangular shape. This results in a significant portion of the incident particle beam not getting through the window of the prior embodiments, a condition which reduces the efficiency of the accelerator system in which the window is being utilized. The problem is then how to permit as much as possible of the circular particle beam to pass through the window while providing adequate cooling for the window foil to prevent its melting or softening and rupture thereof.

This problem is dealt with in the embodiment of FIGS. 5A and 5B by providing a plurality of adjacent, generally rectangular windows 70 in a pair of housing members 72 and 74. Housing members 72 and 74 are held together by screws, clamps or other suitable means (not shown). Foil 20 is mounted between the two housing members in the area of the windows 70 with the foil 20 being bowed as it passes through each window 70 in the manner discussed above in conjunction with FIGS. 4A and 4B. Each pair of adjacent windows 70 are separated by mating struts 76 and 78, the struts 76 being formed in housing 72 and the struts 78 being formed in housing 74. The generally cylindrical curves or bows of the foil in each window 70 come together at the junction of the intermediate strut portions. These junctions of adjacent cylindrical bows may come to a point or such point may be slightly rounded to protect the foil.

As with the embodiment of FIGS. 4A and 4B, a countersink 80 is provided at least in housing 74 in the area of windows 70 to minimize ion loss from angled portions of the particle beam.

To permit substantially all of the circular ion beam to pass through the window openings, the length of each window opening 70, as shown in FIG. 5B, is substantially equal to the diameter of the ion beam and the combined width of windows 70 and the struts therebetween is also substantially equal to the beam diameter. Thus, the only portion of the ion beam which would be lost would be those portions impinging on the struts. Therefore, it is desirable that the ratio of window width to strut width be kept as large as possible consistent with the strut width being adequate to provide the required heat dissipation from the foil.

Water cooling is provided by fluid channels 82 in housing 72. Fluid channels 84 are also shown in struts 76, which channels may be required in some applications to permit adequate cooling. Water cooling through the struts may be particularly necessary if the strut thickness is minimized in order to maximize beam passage through the window.

Figure 6:
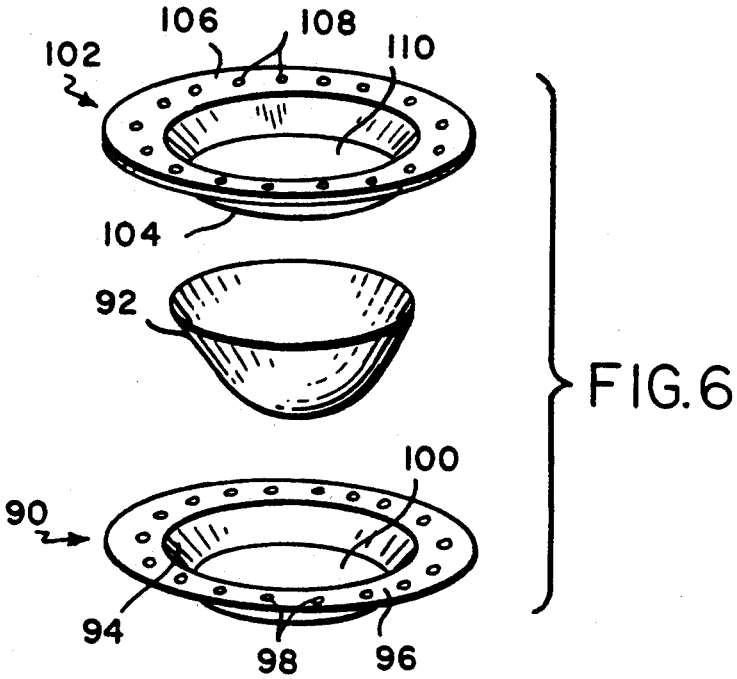
FIG. 6 is an exploded top front perspective view of a spherically bowed embodiment of the invention.

FIG. 6 illustrates another alternative embodiment of the invention wherein the window has a circular or generally circular shape and the foil is bowed in a spherical or near spherical shape. Referring to this figure, a housing member 90 is provided on the beam side of foil 92, which housing has a generally hemispherical section 94 with a connection flange 96 having screw holes 98 formed therein extending around its upper perimeter. A generally circular window opening 100 is formed in the middle of section 94. Foil 92 has a generally spherical shape matching that of the upper surface of section 94. The assembly is completed by a housing member 102 having a lower surface 104 which generally matches the upper surface of spherical section 94. A flange 106 extends around the outer perimeter of member 102 with screw holes 108 being formed in the flange. A window opening 110 is formed in the center of member 102, which opening may be the same size as opening 100, but is preferably somewhat larger than this opening.

One way in which the assembly shown in FIG. 6 may be fabricated is to mount a preformed generally spherical foil 92 on the upper surface of section 94 of housing member 90 and to then mount housing member 102 on top of this combination and use screws in holes 98 and 108 to secure the two members together. Suitable sealing material would be placed between the housings in the manner previously described before they are secured together.

However, a preferred way of forming this assembly is to initially provide a housing 90 with the generally spherical section 94, but without the opening 100. Foil 92 is then formed on the upper surface of section 94 by being vapor deposited, sputtered, or deposited or formed in some other known fashion. Diamond foil is, for example, adapted to be vapor deposited. Opening 100 would then be formed in portion 94 utilizing known techniques for removing a metal such as chemical dissolution or etching. The assembly would then be completed as described above by providing suitable sealing material between members 90 and 102 and screwing or otherwise suitably securing the members together. While in FIG. 6 the foil is shown as being formed on the surface of housing 90 adjacent the accelerator chamber, the bowed surface could also be the mating surface of the other housing.

While the fabricating of the window assembly by depositing or otherwise forming the foil on a suitably shaped housing member and then removing metal to form the window openings has been discussed above in connection with the spherical embodiment of FIG. 6, this technique could also be utilized to form the window construction of other embodiments of the invention, including those shown in FIGS. 4A and 4B and in FIGS. 5 and 5B. For the embodiment shown in FIGS. 5A and 5B, it is also possible to have the struts, and thus the multiple window openings, in only one of the housing members, preferably the housing member adjacent the evacuated chamber, and to have, for example, a circular window opening for the other housing member, which member might generally be of the same form as the housing member 102 shown in FIG. 6.

While water cooling has been shown for various embodiments of the invention, it is also possible, particularly for an embodiment such as that shown in FIG. 6, to use other known methods of cooling a foil window, including passing air or another gas thereover, either in addition to or instead of water cooling to maintain the foil within acceptable temperature limits.

Further, while the invention has been particularly shown and described above with respect to preferred embodiments, it is apparent that other configurations providing the specified perimeter to area ratios and/or foil bowing could also be utilized. The specific housing configurations, mounting methods and cooling methods are also shown for purposes of illustration only and other techniques for achieving these objectives could be utilized. Thus, while the invention has been particularly shown and described above with reference to preferred embodiments, the foregoing and other changes in form and detail may be made therein by one skilled in the art without departing from the spirit and scope of the invention.

What is claimed is:

1. A window construction for use in a particle accelerator having an evacuated beam chamber which is separated by the window from a fluid-filled target area, said window construction comprising:

first and second housing members, each of which has a window opening formed therein;

a thin foil mounted between said members, fully covering said window openings and extending beyond said openings on all sides; and means for securing said members together and for providing a substantially air-tight seal therebetween surrounding said window openings the members have mating curved surfaces selectively extending from the edges of the window openings, and the portion of the foil extending between said curved surfaces being formed into a curved shape by said surfaces, causing the portion of the foil covering the window openings to have the same curve.

2. A construction as claimed in claim 1 wherein said means for securing and for providing a seal includes sealing material between said housings on all sides of said openings.

3. A construction as claimed in claim 1 wherein the window openings have a length and a width dimension, and wherein the bowing of the foil is with a curve having an axis extending in the length dimension, the curved surfaces of the members extending from the length ends of the openings.

4. A construction as claimed in claim 3 wherein said curve is a cylindrical curve.

5. A construction as claimed in claim 1 wherein the curve in the foil in the portion covering the window openings bows in the direction of the evacuated beam chamber.

6. A construction as claimed in claim 1 wherein the bowing of the foil is a generally spherical bowing.

7. A construction as claimed in claim 1 wherein the window openings have a length and a width dimension, and wherein the window openings have a length to-width aspect ratio which is at least 2.

8. A construction as claimed in claim 7 wherein said openings and the portion of the foil covering them are each substantially rectangular.

9. A construction as claimed in claim 8 wherein said rectangular opening has rounded corners.

10. A construction as claimed in claim 7 wherein the width of said window openings are generally as narrow as possible while still providing efficient particle transmission.

11. A construction as claimed in claim 1 wherein said means for securing includes a sealing ring which extends around said opening and between said housings, and means for clamping said foil against said ring to seal the opening.

12. A construction as claimed in claim 1 wherein the foil is formed on at least one of said curved surfaces, and wherein a portion of the member having he curved surface on which the foil is formed is then removed to form the window opening.

13. A construction as claimed in claim 12 wherein the foil material is diamond and is deposited on the surface.

14. A construction as claimed in claim 1 including means for circulating a cooling fluid through at least on of said members in the area thereof adjacent said foil.

15. A construction as claimed in claim 14 wherein said cooling fluid circulating means includes a fluid channel formed in one of said housing members which extends around the periphery of said opening.

16. A construction as claimed in claim 1 wherein said opening and foil are in the form of an annulus.

17. A construction as claimed in claim 1 wherein there is a plurality of adjacent window openings in at least one of said first and second housing members, each pair of adjacent openings being separated by a strut, each of the adjacent window openings having a high length to width aspect ratio.

18. A construction as claimed in claim 17 wherein the ratio of the window opening widths for said adjacent window openings to the widths of the struts therebetween is as large as possible while still achieving required cooling.

19. A construction as claimed in claim 17 including means for reducing the strut heights for at least one of said housings.

20. A construction as claimed in claim 17 including means for circulating cooling fluid through at least one of said members in the area thereof adjacent said foil, said means for circulating including means for circulating fluid through at least selected ones of said struts.

21. A construction as claimed in claim 17 wherein there is a like plurality of adjacent window openings in each of said first and second members.

* * * * *